United States Patent [19]

Jürgens

[11] 4,452,324

[45] Jun. 5, 1984

[54] ROTARY DRILL BIT

[75] Inventor: Rainer Jürgens, Altencelle, Fed. Rep. of Germany

[73] Assignee: Christensen, Inc., Salt Lake City, Utah

[21] Appl. No.: 312,563

[22] Filed: Oct. 19, 1981

[30] Foreign Application Priority Data

Oct. 21, 1980 [DE] Fed. Rep. of Germany ..... 3039633

[51] Int. Cl.[3] ..... E21B 10/66

[52] U.S. Cl. ..... 175/393; 299/81

[58] Field of Search ..... 175/339, 340, 393, 410, 175/422; 299/81

[56] References Cited

U.S. PATENT DOCUMENTS

| | | | |
|---|---|---|---|
| 1,388,490 | 8/1921 | Suman | 175/393 X |
| 3,753,597 | 8/1973 | French | 175/393 X |
| 4,222,447 | 9/1980 | Cholet | 175/340 |
| 4,296,824 | 10/1981 | Kennington | 175/340 |
| 4,303,136 | 12/1981 | Ball | 175/393 X |

FOREIGN PATENT DOCUMENTS

| | | | |
|---|---|---|---|
| 1042019 | 9/1966 | United Kingdom | 299/81 |

*Primary Examiner*—Stephen J. Novosad
*Assistant Examiner*—Joseph Fatt
*Attorney, Agent, or Firm*—Rufus M. Franklin

[57] ABSTRACT

A rotary drill bit, particularly for deep-well drilling, comprising a body (1) having a gauge region, a cutting surface which is defined by projecting cutting members (4) supported at the outer periphery of the body on supporting members and nozzle passages (6 ) through which flushing liquid can flow, and in which at least some of the nozzle passages (6) comprise an outlet region which is directed towards the cutting members and which gives the jets of flushing liquid (10') emerging therefrom an alignment with at least one component facing in the direction of the drillings flowing off along the outer face of the body.

1 Claim, 12 Drawing Figures

ROTARY DRILL BIT

This invention relates to a rotary drill bit, particularly for deep-well drilling.

In known rotary drill bits of this kind, the cutting members of which consist, for example, of small carbide plates coated with polycrystalline diamond material, the nozzle passages from which the flushing liquid emerges which cools the cutting members and washes away the drillings drilled out, are normally disposed perpendicular to the formation, parallel to the axis of the drill bit or in intermediate positions between these two positions. The cooling of the cutting members and the flushing of drillings from the borehole in the cutting region of the drill bit which can be achieved by such arrangements is frequently inadequate, particularly in high performance drilling operations, because the turbulent flow condition of the flushing liquid which is established only cools the cutting members in a secondary flow so that there is an accumulation of drillings in front of the cutting members and an increased sliding friction of the pared off formation chips on the cutting face of the cutting members. This leads to increased wear of the cutting edge of the cutting member as a result of local overheating of the diamond material because of particularly high friction between formation and cutting member.

It is an object of the present invention to provide a rotary drill bit which has an improved flushing action in the interests of longer life of its cutting members.

The present invention is a rotary drill bit, particularly for deep-well drilling, comprising a body having a gauge region, a cutting surface which is defined by projecting cutting members supported at the outer periphery of the body on supporting members and nozzle passages through which flushing liquid can flow, and in which at least some of the nozzle passages comprise an outlet region which is directed towards the cutting members and which gives the jets of flushing liquid emerging therefrom an alignment with at least one component facing in the direction of the drillings flowing off along the outer face of the body.

With this arrangement, the jets of flushing liquid emerging from the nozzle passages are guided directly onto the cutting members so that these are cooled by a thermally unloaded primary stream of the flushing liquid, avoiding eddy formation in the flushing liquid, while, in addition, the component of the jets of flushing liquid facing in the direction of the drillings flowing away renders possible a rapid removal of the drillings by a direct path without accumulation in front of the cutting members. At the same time, an increased sliding friction of the pared off formation chips at the cutting face is prevented by flushing behind it and the chips are deflected in the direction of removal of the drillings and sheared off. In this manner, an intensive cooling and flushing of the cutting members is achieved by means of the flushing liquid so that local overheating of the cutting members is avoided and their life is prolonged considerably.

As a result of the further features of embodiments of the present invention, the stream of flushing liquid which slows down towards the gauge region of the rotary drill bit, depending on the geometry of the latter, can be intensified by the outer or upper nozzle passages which are aligned increasingly tangentially towards the gauge region of the rotary drill bit, while as a result of the outlet diameter of the nozzle passage increasing accordingly towards the gauge region of the rotary drill bit, the amount of flushing liquid increasing towards the outside can be prepared with gaps widening out in a wedge shape between the cutting members.

As a result of a further feature of an embodiment of a rotary drill bit according to the invention, an adaptation of the flushing of the rotary drill bit to the delivery of the flushing pumps and to the speed of flow of the emerging jets of flushing liquid needed according to the particular drilling conditions can be effected by bringing into use nozzle members with appropriately differently formed and dimensioned nozzle passages.

Embodiments of the present invention will now be described, by way of example, with reference to the accompanying drawings, in which.

Figure 1:
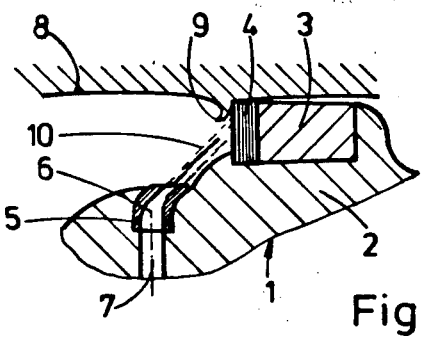
FIG. 1 shows a longitudinal section through a cutting member inserted in a body of a rotary drill bit with associated nozzle passage and adjacent regions of the body and of the formation being drilled.

In FIG. 1, a basic body 1, which consists of a suitable steel in a manner known per se, is provided with a covering 2 of hard material applied thereto in the form of a matrix. A number of support members 3 for cutting members 4 are sintered in position. The cutting members 4, which in this embodiment consist of small carbide metal plates coated with polycrystalline diamond material and are circular in shape, are connected to the associated supporting member 3, for example by soldering, gluing or clamping. Also sintered into the covering 2 of hard material of the body 1 is a nozzle 5, the passage 6 of which has a bent outlet region directed towards the cutting member 4, while the region of the nozzle passage 6 situated in the interior of the covering 2 of hard material is constructed as a straight extension of a flushing liquid passage 7 which is in communication with the usual central flushing liquid bore of the bit.

The earth or rock formation in which the bit works is indicated at 8, chips 9 being pared off the formation 8 by means of the cutting member 4. During the drilling operation, the nozzle channel 6 delivers a jet 10 of flushing liquid which is directed directly onto the cutting face of the cutting member 4 and in addition has a component of movement in the direction of the drillings flowing away in the usual manner along the outer face of the body 1. This development ensures both an intensive cooling of the cutting member 4 and a rapid removal of the drillings.

Figure 2:
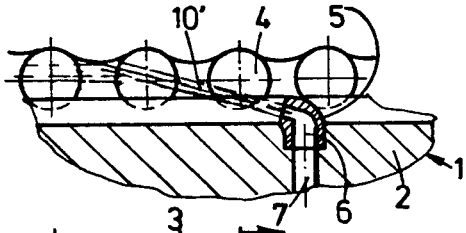
FIG. 2 shows a front view of a row of cutting members with associated nozzle passage of the body in longitudinal section.
Figure 3:
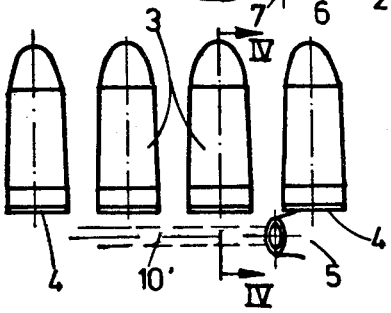
FIG. 3 shows a plan view corresponding to FIG. 2.
Figure 4:
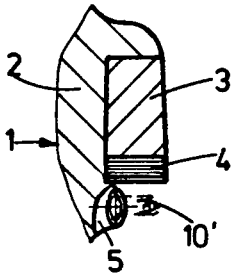
FIG. 4 shows a section on the line IV—IV of FIG. 3.

In the embodiment shown in FIGS. 2 to 4, in which, as throughout this description, the same reference numerals are used to designate like or corresponding parts, the outlet region of the nozzle passage 6 of the nozzle 5 is bent in relation to the axis of the flushing liquid passage 7 and aligned in relation to the cutting members 4 in such a manner that the jet 10' of flushing liquid travels tangentially past the cutting members 4 such that its imaginary central plane is aligned parallel to and slightly spaced from the cutting face of the cutting members 4 associated with the nozzle 5, as FIG. 3 shows in particular. In addition, the jet 10' of flushing liquid is directed tangentially to the solid formation in the direction towards the gauge region of the rotary drill bit, that is to say in the direction of the drillings flowing away, as FIG. 2 shows in particular. With this example of embodiment, too, an intensive cooling of the cutting members 4 is effected by the jet 10' of flushing liquid engaging their cutting face, as well as rapid removal of the drillings as a result of the direction of the jet 10' of flushing liquid corresponding to the flow direction impressed on the stream of flushing liquid flowing away.

Figure 5:
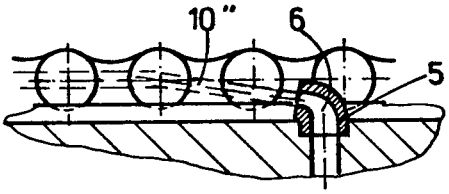
FIG. 5 shows a view corresponding to FIG. 2 to illustrate a further embodiment of the invention.
Figure 6:
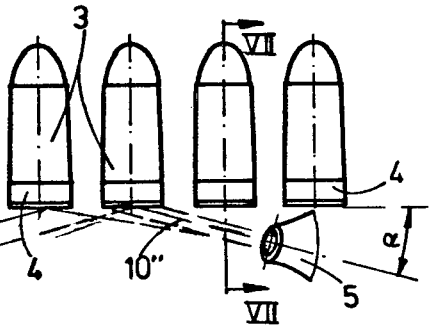
FIG. 6 shows a plan view of the device of FIG. 5.
Figure 7:
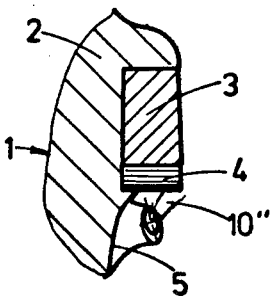
FIG. 7 shows a section on the line VII—VII of FIG. 6.

In the further embodiment shown in FIGS. 5 to 7, the nozzle 5 is arranged in such a manner and the outlet region of its passage 6 is aligned in such a manner that the jet 10'' of flushing liquid intersects the cutting face of associated cutting members 4 with its imaginary central axis at an acute angle $\alpha$. As a result of such a direct action on participating cutting members 4 by the approaching jet 10'' of flushing liquid, a particularly intensive cooling and washing away of the drillings is achieved.

Figure 9:
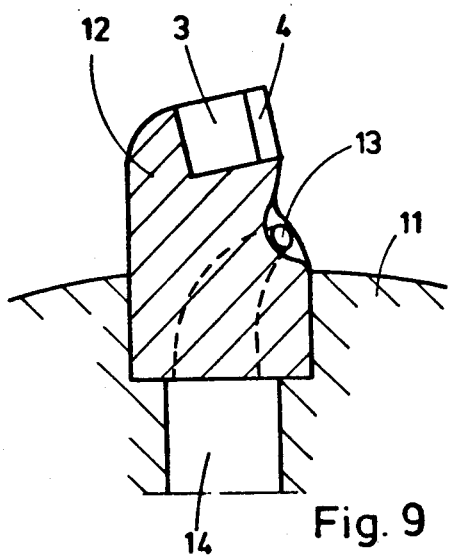
FIG. 9 shows a cross-section through the support vane of FIG. 8.
Figure 10:
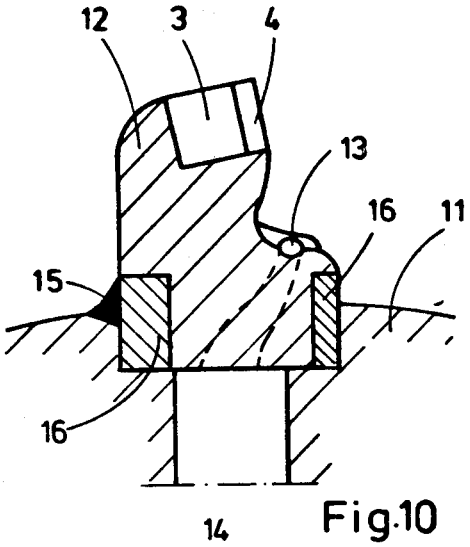
FIG. 10 is a cross-section similar to FIG. 9 and illustrating another embodiment.
Figure 8:
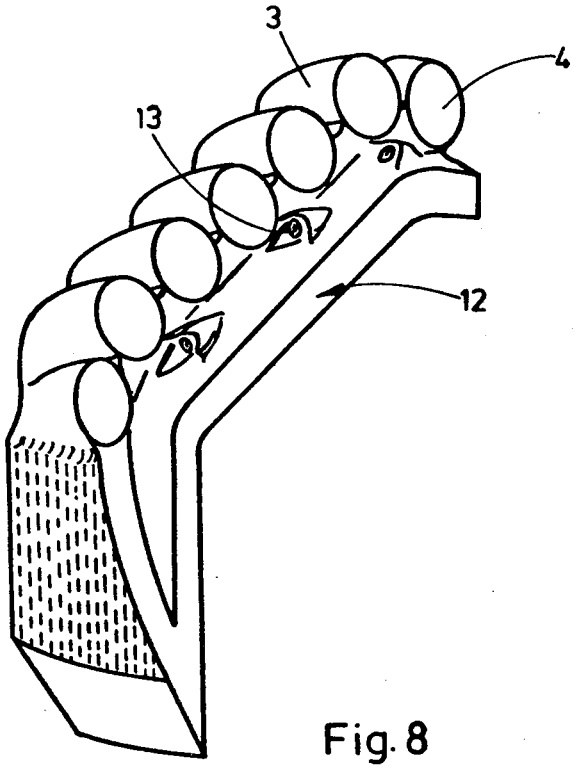
FIG. 8 shows a perspective illustration of a support vane with a group of cutting members and associated nozzle passages.

In the embodiment of FIGS. 8 to 10, supporting vanes 12 are provided for the connection to a bit basic body 11 of a suitable steel, which supporting vanes have a covering of hard material, at least in their top region, into which the cutting members 4 combined with their supporting members 3 are sintered to form a group. Machined in the supporting vanes 12, with appropriate spacing and with appropriate construction and alignment, are nozzle passages 13 with outlet regions which are bent towards the cutting members and in the direction in which the drillings flow away and which are in communication with flushing liquid passages 14 in the basic body 11.

In the embodiment of FIG. 9, the nozzle passages 13 lead into drilling mud grooves while in the example shown in FIG. 10 they end before the drilling mud grooves. The prefabricated supporting vanes 12 can be connected to the basic body 11, which may consist of a normal steel, by furnace hard soldering, but as illustrated in FIG. 10, a welding connection to the basic body 11, indicated at 15, is also possible, provided that the supporting vane 12, which is otherwise formed from a matrix of hard material, is provided with steel strips 16 in the connecting region.

Figure 11:
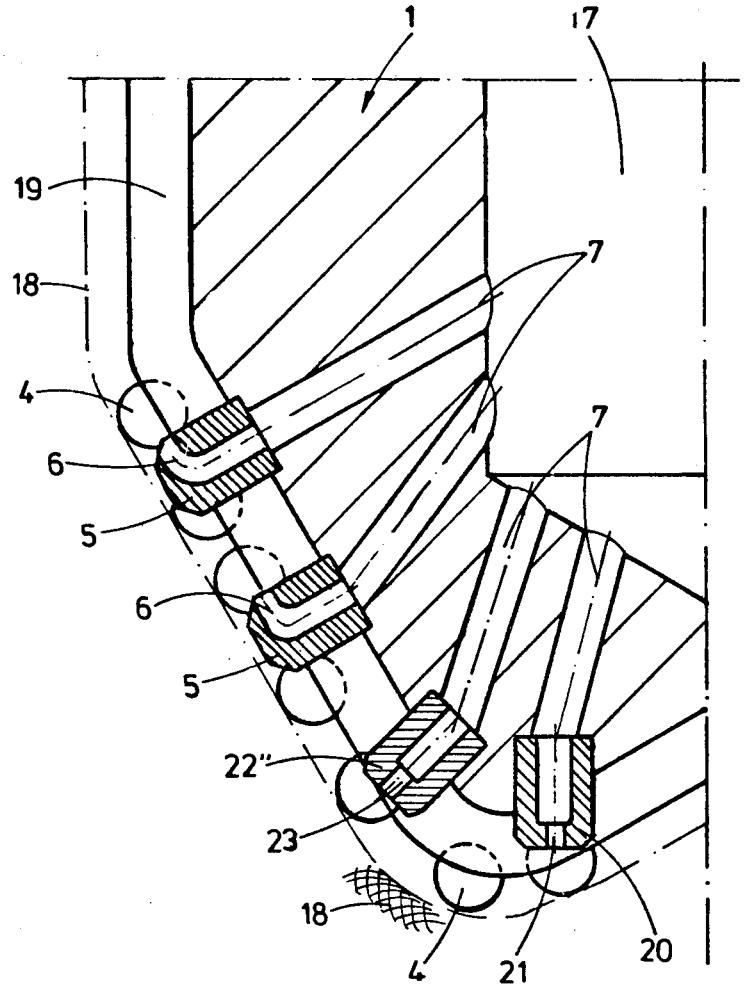
FIG. 11 shows a half axial section through the working region of a rotary drill bit to illustrate differently aligned nozzle passages.

In the embodiment shown in FIG. 11, it can be seen with particular clarity that the nozzle passages 6 of the upper, outer nozzles 5 located in the basic body 1 of the rotary drill bit comprise outlet regions which are bent round or bent at an angle out of the extension axis of the flushing liquid passages 7 towards the gauge region of the rotary drill bit or in the direction of the drillings flowing away along the surface of the body 1. The central flushing liquid bore, with which the flushing liquid passages 7 are in communication, is illustrated at 17 in FIG. 11. The formation is indicated at 18 in FIG. 11.

The formation 18, the basic body 1 and the cutting members 4 inserted in this with their supporting members 3 form a flow passage 19 in which the drillings must be conveyed radially outwards and at the same time upwards from the central region of the rotary drill bit. The removal of the drillings is encouraged by the fact that the jets of flushing liquid emerging from the nozzle passages 6 are directed in the direction of flow of the flow passage 19 or tangentially to the formation 22. In addition, in this example, as explained at the beginning with reference to FIGS. 1 to 7, an alignment of the jets of flushing liquid towards the cutting members 4 is provided. For the intensive cooling of the cutting members 4, which is aimed at, the cone width of the jets of flushing medium emerging from the nozzle passages 6 corresponds, in each case, to the area dimensions of the regions of the cutting members 4 to be acted upon by the flushing liquid.

While the outlet component of the jets of flushing liquid emerging from the bent nozzle passages 6 of the nozzles 5 is directed substantially parallel to the adjacent surface of the basic body 1, in the embodiment shown in FIG. 11, nozzles 20 with nozzle passages 21 aligned parallel to the axis of the drill bit are provided in the central, lower region of the basic body 1 of the rotary drill bit, in an arrangement known per se, and nozzles 22 with nozzle passages 23, which are slightly inclined in relation to the axis of the drill bit and which in turn are in communication with the central flushing liquid bore 17 through the flushing liquid passages 7, are provided in the transition region to the upper region of the basic body 1 occupied by the nozzles 5.

Figure 12:
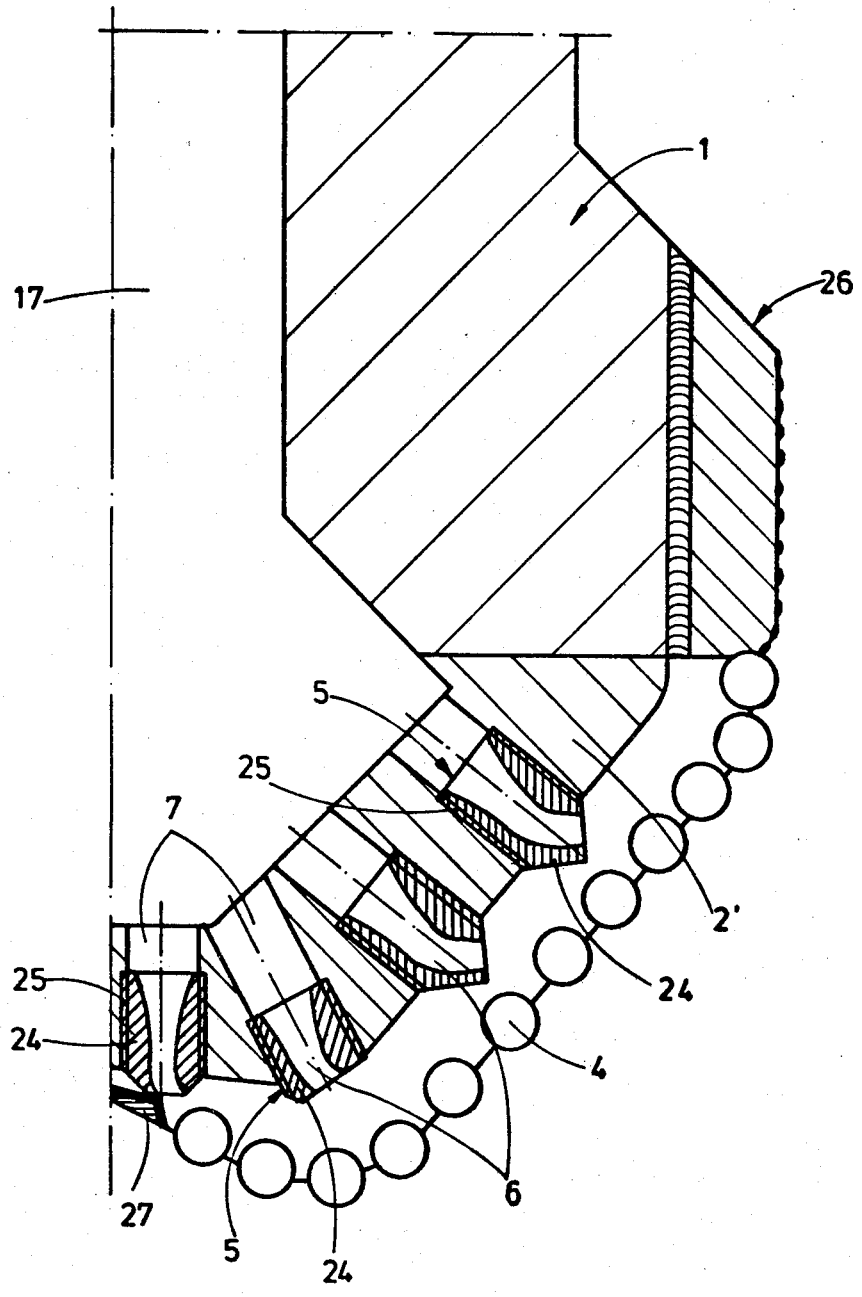
FIG. 12 shows a further embodiment of a rotary drill bit again in half axial section through its working region.

As an alternative, a construction and arrangement according to the embodiment of FIG. 12 is also possible, wherein the directional component of the jets of flushing liquid emerging from the nozzles 5 increases from nozzles disposed in the central region of the basic body 1 towards nozzles provided in the lateral region of the basic body 1. In the embodiment shown in FIG. 12, the nozzles 5 producing such a jet pattern are formed by separate nozzle members 24 of erosion-resistant material, interchangeably secured in the basic body 1. The nozzle members 24 are located in the basic body 1 by means of threaded connections 25 and are in communication with the central flushing liquid bore 17 of the rotary drill bit via the flushing liquid passages 7.

In the embodiment shown in FIG. 12, all the nozzle passages 6 have a bend in their outlet region towards the gauge region, which is illustrated at 26 in FIG. 12. The interchangeability of the nozzle members 24 offers the possibility of effecting adaptations to the particular drilling conditions with regard to the supply of flushing liquid to the cutting surface of the bit, in that fitting nozzle members 24, which are alike in their external diameter, are screwed into the corresponding threaded bores in the basic body 1 but have differently shaped nozzle passages 6. For example, nozzle passages with different diameters, particularly outlet diameters, can easily be provided in such a manner that the outlet diameter of the nozzle passages 6 increases towards the gauge region 26.

From FIG. 12, it can be seen that the nozzle passages 6 of the nozzle member 24 in the central, lower region of the body 1 has the smallest outlet cross-section in comparison with the nozzle passages 6 of the other nozzle members 24.

Instead of lower interchangeable nozzle members 24, immediately adjacent to the axis of the drill bit, nozzles may be sintered or formed directly in the matrix 2' of hard material, because of the more or less restricted space conditions in the central region of the bit depending on the geometry of the bit, just as other smaller cutting members, for example natural or synthetic diamonds, may be sintered into the matrix 2' of hard material, as indicated at 27, instead of the cutting members 4 in this region. An interchangeability of nozzle members in the central region of the rotary drill bit can be dispensed with without appreciable disadvantages to the flushing liquid pattern achieved as a whole.

I claim:

1. A rotary drill bit, particularly for deep-well drilling, comprising a body having a gauge region, a cutting surface which is defined by projecting cutting members having a face and a cutting edge supported at the outer periphery of the body between a central region at the bottom of the bit and a lateral region between the central region and the gauge region on supporting members and nozzle passages through which flushing liquid can flow over and around said bit upwardly to the top of the drill hole and which nozzle passages have outlets spaced about the cutting surface, said outlets being formed so as to direct fluid towards the faces of the cutting members and which gives the jets of flushing liquid emerging therefrom an alignment having at least one flow component facing in the direction of the flushing liquid flowing upwardly around the outer periphery of said body, and in which said one flow component of the jets of flushing liquid emerging from the nozzles increases in magnitude from nozzles disposed in the central region of said body towards nozzles provided in the lateral regions of the body.

* * * * *